United States Patent [19]

Tsunamoto et al.

[11] Patent Number: 4,871,996

[45] Date of Patent: Oct. 3, 1989

[54] WARNING SYSTEM FOR WATERCRAFT

[75] Inventors: Kanichi Tsunamoto; Seiji Inoue, both of Hamamatsu, Japan

[73] Assignee: Sanshin Kogyo Kabushiki Kaisha, Hamamatsu, Japan

[21] Appl. No.: 1,147

[22] Filed: Jan. 7, 1987

[30] Foreign Application Priority Data

Feb. 4, 1986 [JP] Japan ..... 61-22511

[51] Int. Cl.[4] ..... G08B 19/00; B63B 21/52

[52] U.S. Cl. ..... 340/521; 340/984; 340/689; 340/691; 340/573; 440/2; 440/38; 441/11; 441/36; 200/52 A; 200/61.52; 114/275

[58] Field of Search ..... 340/521, 87, 689, 984–988, 340/686, 52 H, 691, 573; 441/11–15, 36; 114/275, 360; 116/173–175; 440/1, 2, 39, 40, 38, 71; 200/61.45 R, 52 A, 61.52, 61.85, 85 A

[56] References Cited

U.S. PATENT DOCUMENTS

| | | | |
|---|---|---|---|
| 2,704,043 | 3/1955 | Drier | 441/71 |
| 3,548,400 | 12/1970 | Boyd et al. | 340/689 |
| 3,701,093 | 10/1972 | Pick | 340/52 H |
| 3,798,631 | 3/1974 | Lansford | 340/573 |
| 3,807,343 | 4/1974 | Peebles | 440/1 |
| 4,022,146 | 5/1977 | Sadler | 440/1 |
| 4,250,829 | 2/1981 | Stephens, Jr. | 440/1 |
| 4,293,968 | 10/1981 | Levine | 441/71 |
| 4,305,143 | 12/1981 | Simms et al. | 340/573 |
| 4,493,656 | 1/1985 | Inoue et al. | 340/689 |
| 4,598,278 | 7/1986 | Ford | 440/2 |

*Primary Examiner*—Donnie L. Crosland
*Attorney, Agent, or Firm*—Ernest A. Beutler

[57] ABSTRACT

A watercraft incorporating improved warning devices for providing a warning signal in response to a abnormal condition. The abnormal condition may be either the condition when a rider is no longer present on the watercraft or when the watercraft assumes a non-normal running condition such as being capsized or inverted. In some instances, the warning is provided by a flag, a light, by a warning jet spray of water and, in others, by an audible signal. The warning may be combined so that more than one type of warning is given in response to an abnormal condition.

29 Claims, 5 Drawing Sheets

Fig-3
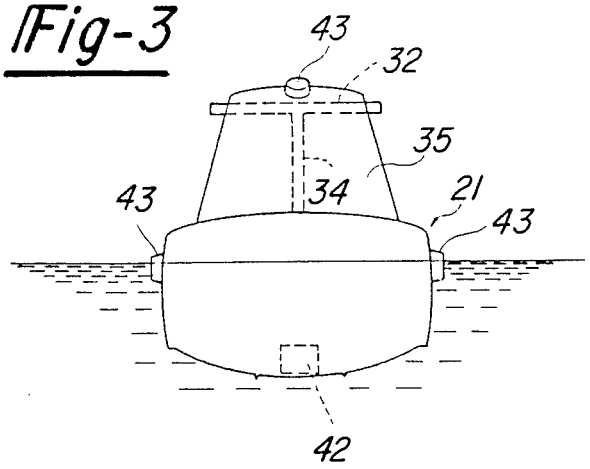
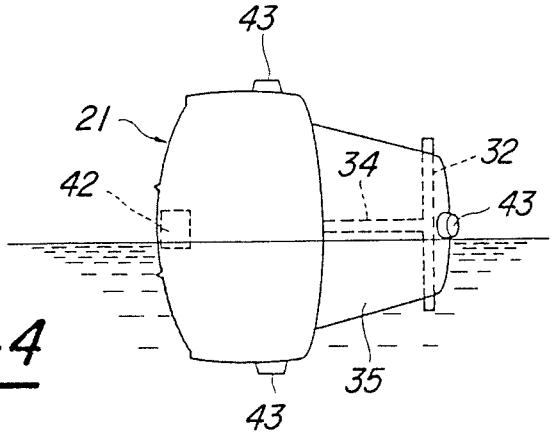
Fig-4
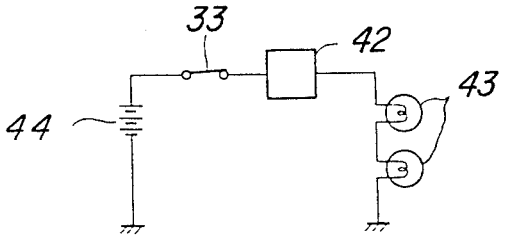
Fig-5
Fig-6
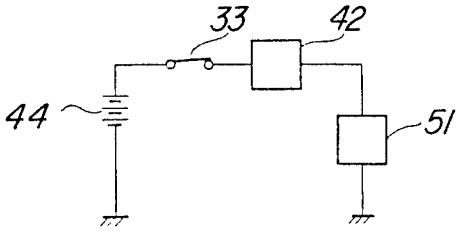

WARNING SYSTEM FOR WATERCRAFT

BACKGROUND OF THE INVENTION

This invention relates to a warning system for a watercraft and more particularly to a device that provides a warning in the event the watercraft assumes an abnormal condition in the body of water in which it is operating.

In a watercraft, there may arise conditions under which the watercraft may assume an abnormal condition in the body of water in which it is operating. Such an abnormal condition may be indicative of some problem such as the watercraft being capsized, inverted or the occupant or occupants of the watercraft having fallen overboard. In order to permit recovery and rescue, it is desirable if some arrangement can be provided so as to indicate that such a condition exists. For example, it is desirable to provide an arrangement wherein a signal is given under these conditions so as to permit remote parties to sense the condition and effect a recovery.

It is, therefore, a principal object of this invention to provide an improved warning system for a watercraft.

It is a further object of this invention to provide a system for issuing a warning from a watercraft when the watercraft assumes an abnormal condition in the water.

It is a further object of this invention to provide a signal arrangement for a watercraft wherein a signal is given when an abnormal condition exists so as to facilitate recovery.

One particularly popular type of watercraft is a small jet propelled vehicle that is designed to be operated by one or two riders.

Because of the compact size of this type of watercraft, it is even more important to provide a good warning arrangement in the event of an abnormal condition of the type as aforedescribed. Furthermore, this type of watercraft is normally designed so as to be ridden with the occupants wearing swimsuits or wetsuits because they anticipate the possibilities of leaving the watercraft.

It is, therefore, a still further object of this invention to provide an improved warning system for a small watercraft.

It is another object of this invention to provide a warning system for a small watercraft that will indicate when the rider becomes displaced from the watercraft.

It is a further object of this invention to provide a warning system for a watercraft that will give a warning that can be seen or heard at great distances.

SUMMARY OF THE INVENTION

A first feature of this invention is adapted to be embodied in a watercraft that is adapted to ride in the water in a normal condition and which is displaceable into a non-normal condition in the event of an abnormal situation. In accordance with this feature of the invention, means are provided that give a warning signal in response to the watercraft assuming the non-normal condition.

Another feature of the invention is adapted to be embodied in a watercraft comprising a hull, a rider's area upon the hull, and powering means for powering the watercraft. In accordance with this feature of the invention, means are provided for giving a warning signal if a rider becomes displaced from the rider's area.

Another feature of the invention is adapted to be embodied in a watercraft comprising a hull. A warning flag is movably supported by the hull for movement between a storage position and an extended warning condition indicating position. Means are provided for moving the flag from its storage position to its warning condition indicating position in response to a warning condition.

Yet another feature of the invention is adapted to be embodied in a watercraft having a hull and a spray port for directing a spray from the hull in an upward direction. In accordance with the invention, warning means are provided for directing a spray from the spray port in the event of an abnormal condition.

BRIEF DESCRIPTION OF THE DRAWINGS

FIG. 3 is a rear elevational view of the watercraft of the second embodiment when operating in an upright condition.

FIG. 4 is a rear elevational view, in part similar to FIG. 3, showing the watercraft in a capsized condition.

FIG. 5 is a schematic view showing the activating circuit of the warning device of the embodiment of FIGS. 2 through 4.

FIG. 6 is a schematic view showing a warning device constructed in accordance with another embodiment of the invention.

DETAILED DESCRIPTION OF THE PREFERRED EMBODIMENTS

Figure 1:
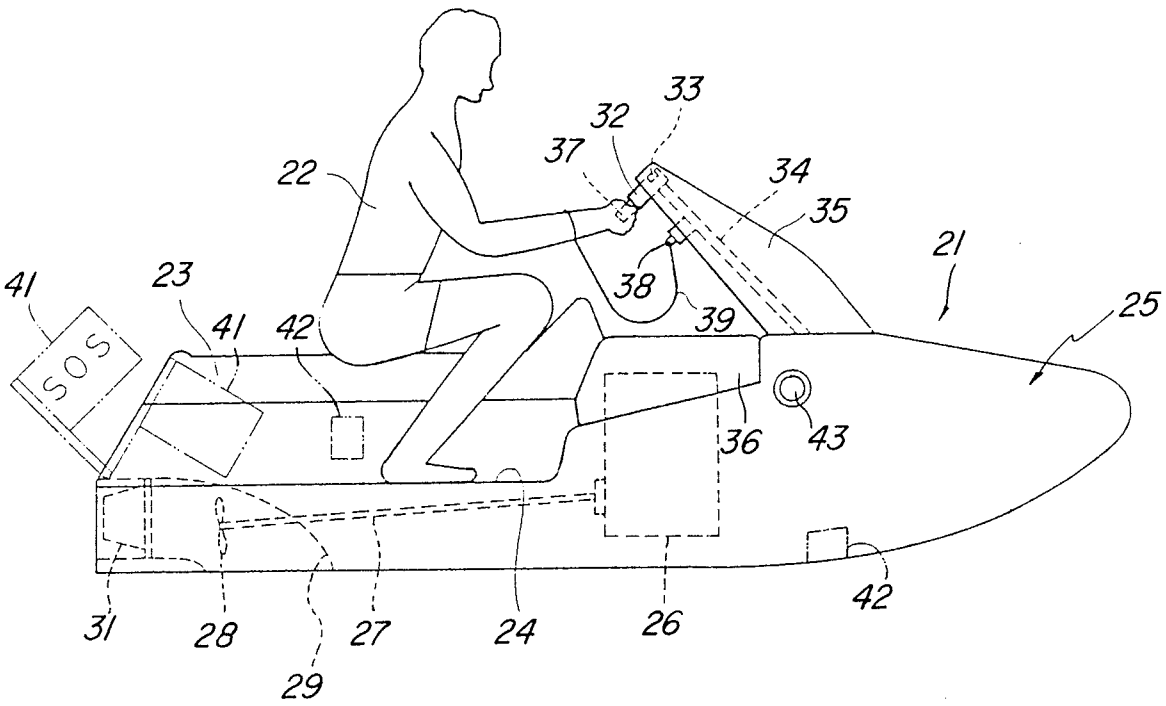
FIG. 1 is a side elevational view of a watercraft constructed in accordance with a first embodiment of the invention.

Referring first to FIG. 1, a small watercraft constructed in accordance with an embodiment of the invention is identified generally by the reference numeral 21. The watercraft 21 is of the type that is designed to be operated primarily by a single rider, indicated at 22, seated in straddle fashion on a seat 23 of the watercraft 21 with his legs positioned in footwells 24 defined at opposite sides of a hull 25.

Contained within the hull 25 is a powering internal combustion engine 26 that has a drive shaft 27 which drives an impeller 28 of a jet drive unit. The jet drive unit includes an inlet 29 which is disposed on the lower side of the hull 25 and through which water is drawn by the impeller 28.

This water is discharged through a pivotally supporting steering nozzle 31 so as to permit steering of the watercraft 21.

This steering is accomplished by means of a steering handlebar assembly 32 that is connected to the upper end of a steering column 34. The steering column 34 is, in turn, journaled within a mast 35 of the hull 25. The steering shaft 34 is connected in any suitable manner to the steering nozzle 31 for steering it.

A main ignition switch 33, which may be key operated, is carried by the mast to control the main electrical system and ignition of the watercraft 21.

The mast 35 extends upwardly and rearwardly and overlies the engine 26. A hatch cover 36 is affixed to the hull 25 and is removable so as to afford access to the engine 26.

The speed of the engine 26 is controlled by means of a rotatable throttle control 37 that is provided on one of the handlebars 32 for speed control in a known manner.

The watercraft is provided with a kill switch for killing the engine 26 by grounding the ignition system or in any other known manner in the event that the rider 22 becomes inadvertently displaced from the watercraft 21. Such a kill switch is indicated at 38 and is connected by means of a safety harness 39 to the rider's wrist so that if the rider becomes displaced from the watercraft, the kill switch 38 will be activated and the motor 26 will be stopped.

There is also provided a signaling device, indicated generally by the reference numeral 41, which is effective to provide a signal that will indicate the location of the watercraft 21 and also the fact that the rider has been displaced from it. In this embodiment, the signal 41 comprises a pivotally supported flag that is normally retained in a retracted storage position wherein it will not be visible. However, if the rider 22 becomes displaced, the flag 41 will be erected as shown in the one phantom view in FIG. 1. Such arrangement can be done by providing a latching mechanism that normally holds the flag 41 in a storage position but which is released by a motor when the rider becomes displaced.

Displacement of the rider 22 may be sensed in a variety of fashions and one of these ways is to provide a trim position sensor 42 which may be either located under the seat 23 or forwardly in the hull 25 and which is sensitive to the trim condition of the watercraft. When a rider 22 is in place, the trim condition will be normally balanced but when the rider is displaced, the nose of the hull 25 will tilt downwardly and the trim condition will change. The device 42 sends a signal when this condition occurs. However, there may be incorporated in the activating circuit a time delay so that the flag will not be erected during normal trim changes as are encountered during normal watercraft operation.

In addition to the warning flag 41, the watercraft may be provided with a pair of warning lights 43 which are suitably illuminated in the event the rider 22 is displaced through activation by the warning sensors 42 in the same manner as the flag 41.

FIGS. 2 through 5 show another embodiment of the invention which is generally similar to the embodiment of FIG. 1 but which deletes the warning flag and only employs the warning lights 43. Because of its similarity to the previously described embodiment, the same components have been identified by the same reference numerals and will not be described again in detail, except insofar as is necessary to understand the construction and operation of this embodiment.

Figure 2:
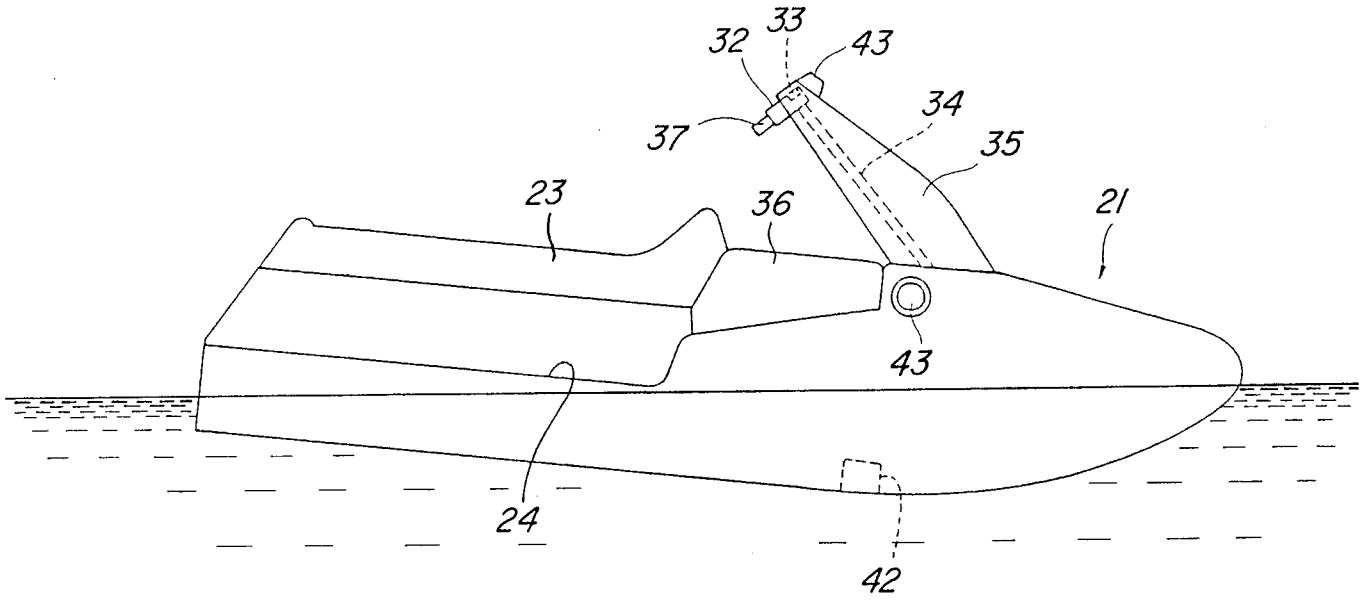
FIG. 2 is a side elevational view of a watercraft constructed in accordance with a second embodiment of the invention.

In this embodiment, warning lights 43 are carried at opposite sides of the hull 25 and also a warning light 43 is carried at the upper end of the mast 35. FIGS. 2 through 4 show how that at least one of the warning lights 43 will be visible regardless of whether the operator becomes displaced from the watercraft and it remains upright (FIGS. 2 and 3) or even if the watercraft becomes capsized (FIG. 4).

The circuit for activating the warning lights 43 is illustrated in FIG. 5 and includes a battery 44 that is in circuit with the warning indicator 42 through the ignition switch 33. In this embodiment, the indicator 42 operates with a time delay if the warning lights are activated in response to a charge in trim condition so that the lights will not be operated during normal running and only when a rider is displaced from the watercraft. However, no time delay is incorporated in the event the watercraft 21 becomes capsized and the warning lights 43 will be activated immediately in this condition.

As shown in FIG. 6, the warning system may include a warning buzzer 51 that is in circuit with the warning indicator 42, ignition switch 33 and battery 44. Of course, devices such as the flag 41, warning lights 43, warning buzzer 51 may be used in combination.

Figure 7:
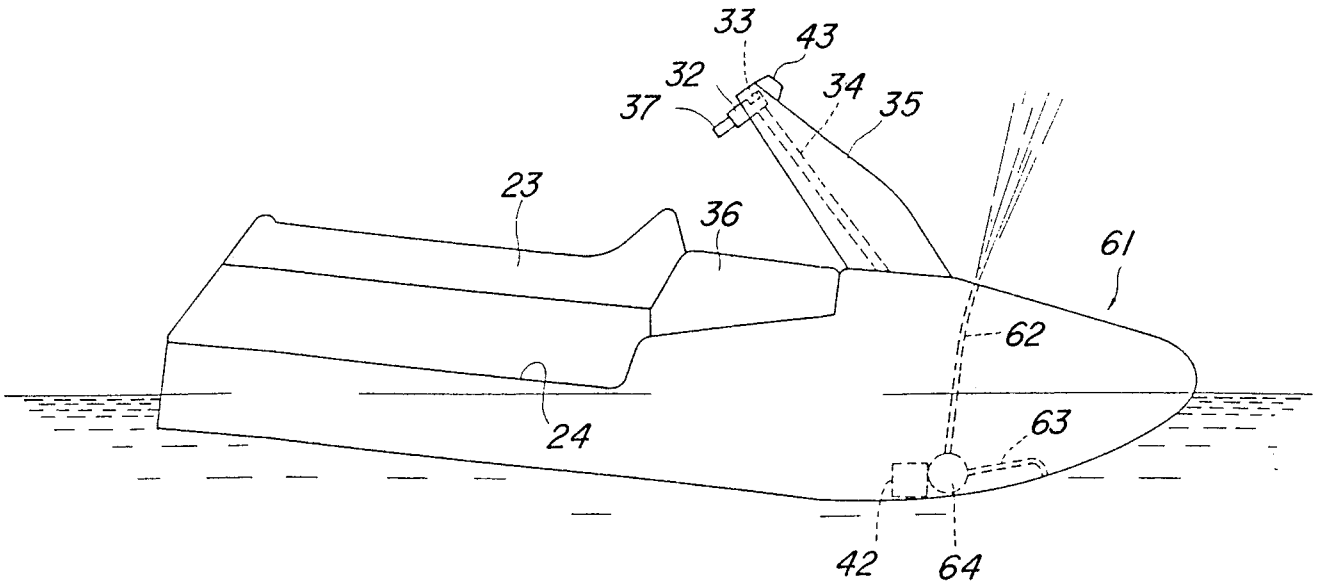
FIG. 7 is a side elevational view of a watercraft constructed in accordance with yet another embodiment of the invention.
Figure 8:
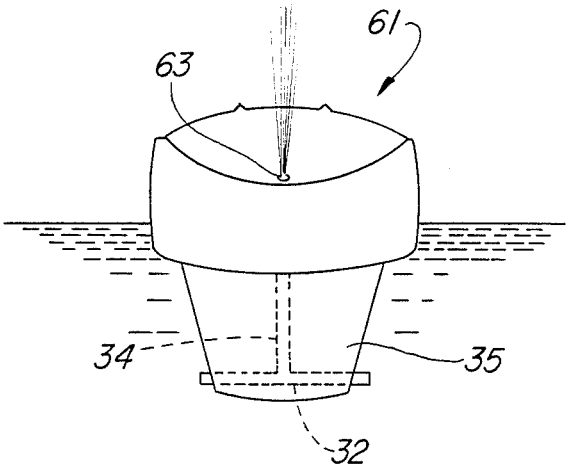
FIG. 8 is a rear elevational view of the embodiment of FIG. 7, showing the watercraft in an inverted position.
Figure 9:
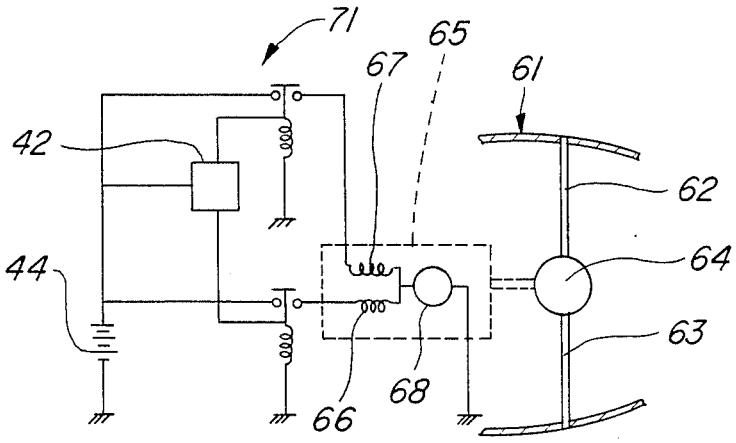
FIG. 9 is a schematic view showing the detailed construction of the operation of the warning system of the embodiment of FIGS. 7 and 8.

Referring now to FIGS. 7 through 9, an additional warning system is disclosed wherein a warning signal is provided by means other than or in addition to the warning lights 43. In this embodiment, the watercraft is identified generally by the reference numeral 61, however, many of the basic components of the watercraft are the same as the previously described embodiment. Where this is the case, those components have been identified by the same reference numerals and will be described again in detail only insofar as is necessary to understand the construction and operation of this embodiment.

Figure 10:
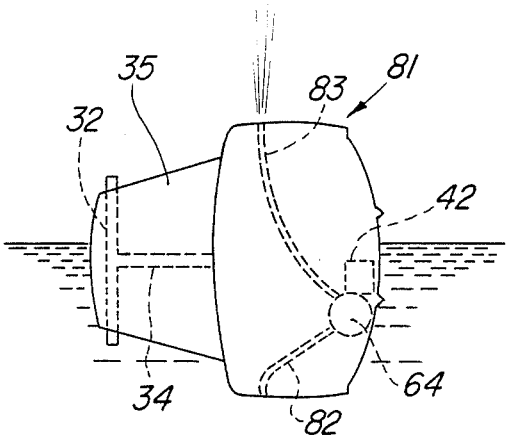
FIG. 10 is a rear elevational view, in part similar to FIG. 8, showing yet another embodiment of the invention.

In this embodiment, the warning signal is provided by the discharge of a spray or water jet through either a deck positioned outlet nozzle and conduit 62 or a hull positioned outlet nozzle and conduit 63. Water is delivered from one of these nozzles to the other of the nozzles and conduits by means of a reversible electric pump 64 that is triggered by the warning sensor 42 in a manner as best understood by references to FIG. 10, which is a schematic view of the warning system. In FIG. 10, it will be seen that the reversible pump 64 is powered by a reversible electric motor 65 that has a pair of windings 66 and 67 that cooperate with an armature 68 so as to effect rotation in either a forward or reverse direction. The windings 66 and 67 are energized by respective relay switches 69 and 71 that are operated by the warning device 42 to complete a circuit from the battery 44 through either the winding 66 or the winding 67 to cause either the conduit 63 to act as an inlet conduit and the conduit 62 to act as a discharge conduit or vice versa.

If the watercraft 61 is operating in a normal upright condition and the rider becomes displaced, the warning indicator 42 will, after a time delay, send a signal so as to energize the winding 66 so that the pump 64 is driven in a manner that the conduit 63 acts as the inlet conduit and the conduit 62 acts as an outlet conduit. Under this condition, a spray of water (FIG. 7) will be discharged through the nozzle 62 in an upward direction so as to provide a warning indication.

If, on the other hand, the watercraft 61 becomes inverted (FIG. 8), the warning indicator 42 will immediately trigger a signal so as to energize the relay 71 and the winding 67 so that the pump 64 will be operated so that the conduit 62 forms the inlet conduit and the conduit 63 forms the outlet conduit. Then, a spray of water will be discharged through the hull upwardly and the warning indication will again be achieved.

FIG. 10 illustrates a still further embodiment of the invention wherein a watercraft 81 is also provided with a pair of side discharge conduits and nozzles 82 and 83. Such an arrangement may be used in lieu of the arrangement shown in FIGS. 7 through 9 or in addition to it.

In this embodiment, the warning device 42 also provides an appropriate signal to the pump 64 and particularly its driving motor so as to sense if the watercraft has been capsized on one side or the other. Then, depending upon which side is submerged and which side is above the water, either the conduit 82 or the conduit 83 will function as an inlet conduit and the other conduit will function as a discharge conduit. In FIG. 10, it is illustrated that the boat is capsized so that the conduit 83 is above the water. In this instance, the pump 64 is operated so that water is drawn through the conduit 82 and discharged through the conduit 83 to provide the warning signal. Of course, the device can be reversed and it should be clear to those skilled in the art how the warning unit 42 may sense the actual condition of the watercraft.

It should be readily apparent from the foregoing description that a wide variety of embodiments of the invention have been illustrated and described, each of which provides a very adequate warning system in the event of a rider becoming displaced from a watercraft or if the watercraft becomes capsized or inverted. As has been noted, the warning systems may be utilized independently of each other or in a wide variety of combinations. In addition to the embodiments illustrated and described, various other changes and modifications may be made without departing from the spirit and scope of the invention, as defined by the appended claims.

We claim:

1. In a powered watercraft adapted to ride in the water in a normal trim condition under its own power when occupied by a rider and being displaceable into a non-normal trim condition in the water in the event the rider is displaced from the watercraft, the improvements comprising means for providing a warning signal emanating from said watercraft and that can be recognized from a distance from the watercraft by a person other than the rider in response to said watercraft assuming said non-normal trim condition in the water for location of the watercraft and displaced rider.

2. In a watercraft as set forth in claim 1 wherein the warning signal is a visual sign.

3. In a watercraft as set forth in claim 2 wherein the visual signal is provided by a warning light.

4. In a watercraft as set forth in claim 2 wherein the visual signal is provided by the erection of a flag.

5. In a watercraft as set forth in claim 1 wherein the warning signal is an audible signal.

6. In a watercraft as set forth in claim 1 wherein the watercraft may assume several non-normal trim conditions in the water and the signal is provided when any of the abnormal conditions exist.

7. In a watercraft as set forth in claim 6 wherein a different warning signal is provided for a different non-normal trim condition.

8. In a watercraft as set forth in claim 1 wherein the warning signal is provided after the watercraft assumes the non-normal trim condition for more than a predetermined time period.

9. In a watercraft as set forth in claim 8 wherein the warning signal is a visual signal.

10. In a watercraft as set forth in claim 9 wherein the visual signal is provided by a warning light.

11. In a watercraft as set forth in claim 9 wherein the visual signal is provided by the erection of a flag.

12. In a watercraft as set forth in claim 9 wherein the visual signal is provided by a jet spray of water.

13. In a watercraft as set forth in claim 8 wherein the warning signal is an audible signal.

14. In a watercraft adapted to ride in the water in a normal trim condition when occupied by a rider and being displaceable into a non-normal trim condition in the water in the event the rider is displaced from the watercraft, the improvements comprising means for providing a warning signal that can be recognized from a distance from the watercraft by a person other than the rider in response to said watercraft assuming said non-normal trim condition in the water so that the watercraft and displaced rider can be located, said signal comprising a visual signal provided by a jet spray of water.

15. In a watercraft comprising a hull, a rider's area upon said hull, and powering means for powering said watercraft, and means for providing a warning signal that can e recognized from a distance from the watercraft by a person other than the rider in response to the rider's area becoming unoccupied.

16. In a watercraft as set forth in claim 15 wherein the warning signal is a visual signal.

17. In a watercraft as set forth in claim 16 wherein the visual signal is provided by a warning light.

18. In a watercraft as set forth in claim 16 wherein the visual signal is provided by the erection of a flag.

19. In a watercraft as set forth is claim 16 wherein the visual signal is provided by a jet spray of water.

20. In a watercraft as set forth in claim 15 wherein the warning signal is an audible signal.

21. In a watercraft as set forth in claim 15 wherein the warning signal is responsive to a shift in the riding condition of the watercraft to indicate that a rider is no longer on the watercraft.

22. In a watercraft as set forth in claim 21 wherein the warning signal is a visual signal.

23. In a watercraft as set forth in claim 22 wherein the visual signal is provided by a warning light.

24. In a watercraft as set forth in claim 22 wherein the visual signal is provided by the erection of a flag.

25. In a watercraft as set forth in claim 22 wherein the visual signal is provided by a jet spray of water.

26. In a watercraft as set forth in claim 21 wherein the warning signal is an audible signal.

27. In a watercraft operable in a normal running condition and capable of being operated in an abnormal running condition comprising a hull, a rider's area accommodating a rider upon said hull, and power means for powering said watercraft, the improvement comprising means for providing a water jet spray in response to an abnormal running condition.

28. In a watercraft comprising a hull as set forth in claim 27 wherein the water jet spray is provided in response to an abnormal trim condition of the watercraft in the water.

29. In a watercraft comprising a hull as set forth in claim 28 wherein the watercraft is capable of being capsized or tipped on either of its sides and a water spray is provided from the upwardly extending portion of the hull regardless of which of the abnormal conditions the watercraft assumes.

* * * * *

UNITED STATES PATENT AND TRADEMARK OFFICE

CERTIFICATE OF CORRECTION

PATENT NO. : 4,871,996

DATED : October 3, 1989

INVENTOR(S) : Tsunamoto, et al

It is certified that error appears in the above-identified patent and that said Letters Patent is hereby corrected as shown below:

Abstract line 1, "A" should be --Several embodiments of--.

Abstract line 2, "a" (second occurrence) should be --an--.

Column 4, line 11, "charge" should be --change--.

Column 5, line 51, Claim 2, "sign" should be --signal--.

Column 6, line 24, Claim 15, "and" should be --the--.

Column 6, line 25, Claim 15, "e" should be --be--.

Signed and Sealed this

Nineteenth Day of May, 1992

*Attest:*

DOUGLAS B. COMER

*Attesting Officer*

*Acting Commissioner of Patents and Trademarks*